US006893536B2

(12) United States Patent
Ilmonen et al.

(10) Patent No.: US 6,893,536 B2
(45) Date of Patent: May 17, 2005

(54) PROCESS AND COATING COMPOSITION FOR COATING A PAPER WEB

(75) Inventors: Teuvo Ilmonen, Äänekoski (FI); Soili Hietanen, Espoo (FI); Markku Leskelä, Muijala (FI)

(73) Assignee: M-Real Oyj, Espoo (FI)

( * ) Notice: Subject to any disclaimer, the term of this patent is extended or adjusted under 35 U.S.C. 154(b) by 158 days.

(21) Appl. No.: 10/181,566

(22) PCT Filed: Jan. 29, 2001

(86) PCT No.: PCT/FI01/00084

§ 371 (c)(1),
(2), (4) Date: Jul. 18, 2002

(87) PCT Pub. No.: WO01/55506

PCT Pub. Date: Aug. 2, 2001

(65) Prior Publication Data

US 2003/0106658 A1 Jun. 12, 2003

(30) Foreign Application Priority Data

Jan. 28, 2000 (FI) ..... 20000186

(51) Int. Cl.[7] ..... D21H 15/00

(52) U.S. Cl. ..... 162/135; 162/136; 162/181.2; 162/184; 162/204; 162/147; 162/205; 162/206; 106/465; 106/467

(58) Field of Search ..... 162/135, 136, 162/181.2, 184, 204, 147; 106/465, 467

(56) References Cited

U.S. PATENT DOCUMENTS 5,262,006 A * 11/1993 Andersson et al. ..... 162/147
5,753,077 A * 5/1998 Horand et al. ..... 162/135
6,248,407 B1 * 6/2001 Hess ..... 427/426

FOREIGN PATENT DOCUMENTS

| | | |
|---|---|---|
| EP | 0 216 516 A1 | 4/1987 |
| EP | 0 790 135 A2 | 8/1997 |
| EP | 0 942 099 A2 | 9/1999 |
| GB | 2179956 A | 3/1987 |
| WO | WO 87/02722 | 5/1987 |
| WO | 97/44524 A1 | 11/1997 |

OTHER PUBLICATIONS

Derwent's abstract, Nr 1979–30229B, week 7916, Abstract of JP, A, 54030911, (Kuraray Co Ltd), (Mar. 7, 1979).

* cited by examiner

*Primary Examiner*—Mark Halpern
(74) *Attorney, Agent, or Firm*—Kubovcik & Kubovcik

(57) ABSTRACT

The invention relates to a process for producing a coated paper web, According to the process, a paper web is formed from a fibrous raw material in a paper machine, the paper web is coated with a pigment-containing coating mix, and the coated paper web is calendered. According to the invention, the paper web is coated with a coating composition that contains as the mineral pigment mainly a mixture of gypsum and calcium carbonate, the amount of gypsum being at minimum 10% by weight of the total amount of gypsum and calcium carbonate. With mixtures of calcium carbonate and gypsum, such as mixtures of PCC and gypsum and mixtures of PCC, ground carbonate and gypsum, there are obtained simultaneously a sufficient gloss and smoothness as well as a brightness and opacity better than with PCC-kaolin pastes.

22 Claims, 11 Drawing Sheets

PROCESS AND COATING COMPOSITION FOR COATING A PAPER WEB

This application is a 371 of PCT/FI01/00084 filed on Jan. 29, 2001, and claims foreign priority based on application 20000186 filed in Finland on Jan. 28, 2000.

The present invention relates to a method according to the preamble of claim 1 for producing a coated and calendered paper web.

According to such a method, a paper web is formed in the paper machine from a fibrous raw material and the web is coated and calendered.

The invention also relates to a coating composition according to the preamble of claim 19, which coating composition contains a mineral pigment, a binder, and additives known per se.

The trend commonly associated with coated papers is that they are increasingly used for printing color images. In terms of the quality of color images, the so-called color space is an important concept. In practice this means that the higher the paper brightness, the more different color tones can be printed on the paper surface. For the same reason the paper must be as smooth as possible.

The brightness of paper can be increased by coating the paper web with coating mixes which contain mineral pigments. Prior-known coating mixes (slips) and their pigments have a disadvantage in the uneven distribution of the coating, i.e. poor cover. Especially with small amounts of coating, poor cover leads to problems of mottling in printing and to mottled paper brightness. Attempts are often made to reduce mottling by increasing the amount of coating, which in turn leads to other problems. In order to maintain the economy of paper making, it is in general necessary to reduce the weight of the base paper (the total weight of the coated paper is maintained unchanged), and as a result the bulk and stiffness are worsened and possibly the opacity is reduced.

The object of the present invention is to eliminate the disadvantages associated with the prior art and to provide a novel option for coating paper and board webs.

The invention is based on the surprising observation that, when paper or a corresponding fibrous web is coated with a coating mix which contains gypsum as a pigment together with finely-divided calcium carbonate, such as ground or preferably precipitated carbonate, the brightness of the paper is significantly improved. At the same time the smoothness and gloss of the paper remain good.

The major proportion of the mineral pigment in the coating mix according to the invention is made up of a mixture of gypsum and carbonate, gypsum constituting at least 10% of the total amount of the pigment in the mixture. The coating compositions contain in addition to pigments at least a binder and possibly additives known per se, such as thickeners.

More specifically, the method according to the invention is mainly characterized by what is stated in the characterizing part of claim 1.

The coating composition according to the invention, for its part, is characterized by what is stated in the characterizing part of claim 19.

The invention provides considerable benefits. Previously, in order to ensure sufficient gloss, it has been necessary to use in the coating mix a kaolin with a plate-like particle form, but now, sufficient gloss and smoothness as well as better brightness and opacity than with PCC-kaolin mixtures have been obtained with mixtures of calcium carbonate and gypsum, such as mixtures of PCC and gypsum and mixtures of PCC, ground carbonate and gypsum.

The advantages achieved are explainable partly by the advantageous mutual packing of the pigments and partly by the good cover provided by the coating composition according to the invention. By means of the present invention, a coating is obtained wherein the pigment seems to become arranged like a house of cards on the surface of the web. From the literature of the field there is known well the concept of house-of-cards-like packing of pigment. This concept contains as an essential part the idea that, for example, among plate-like kaolin particles it is good to have, for example, spherical particles which prevent a tight settling of kaolin particles against one another and thus make the structure porous and advantageous for the absorption of color and the scattering of light. In practice, observing a house-of-cards-like structure in, for example, microscopic photographs is very difficult or impossible, and the advantages of a house-of-cards-like structure are indeed seen indirectly in the other properties of the paper. No suggestion that house-of-cards-like packing could be achieved with gypsum pigment is found in the literature.

Paper produced by the process according to the invention has good printability properties for heatset printing, and its brightness, opacity, gloss and smoothness are good. The process and coating composition according to the invention can therefore be used for the production of various printing papers. The invention is in particular suitable for coating papers to be used for multi-color printing. A gypsum-containing pigment is well suited for the coating of electrophotography papers, since it has an advantageous effect on the electric properties of the paper surfaces.

The invention will be examined below in greater detail with the help of a detailed description and with reference to the accompanying drawings, wherein FIG. 1 depicts the brightness of glossy papers in different tests;

Figure 1:
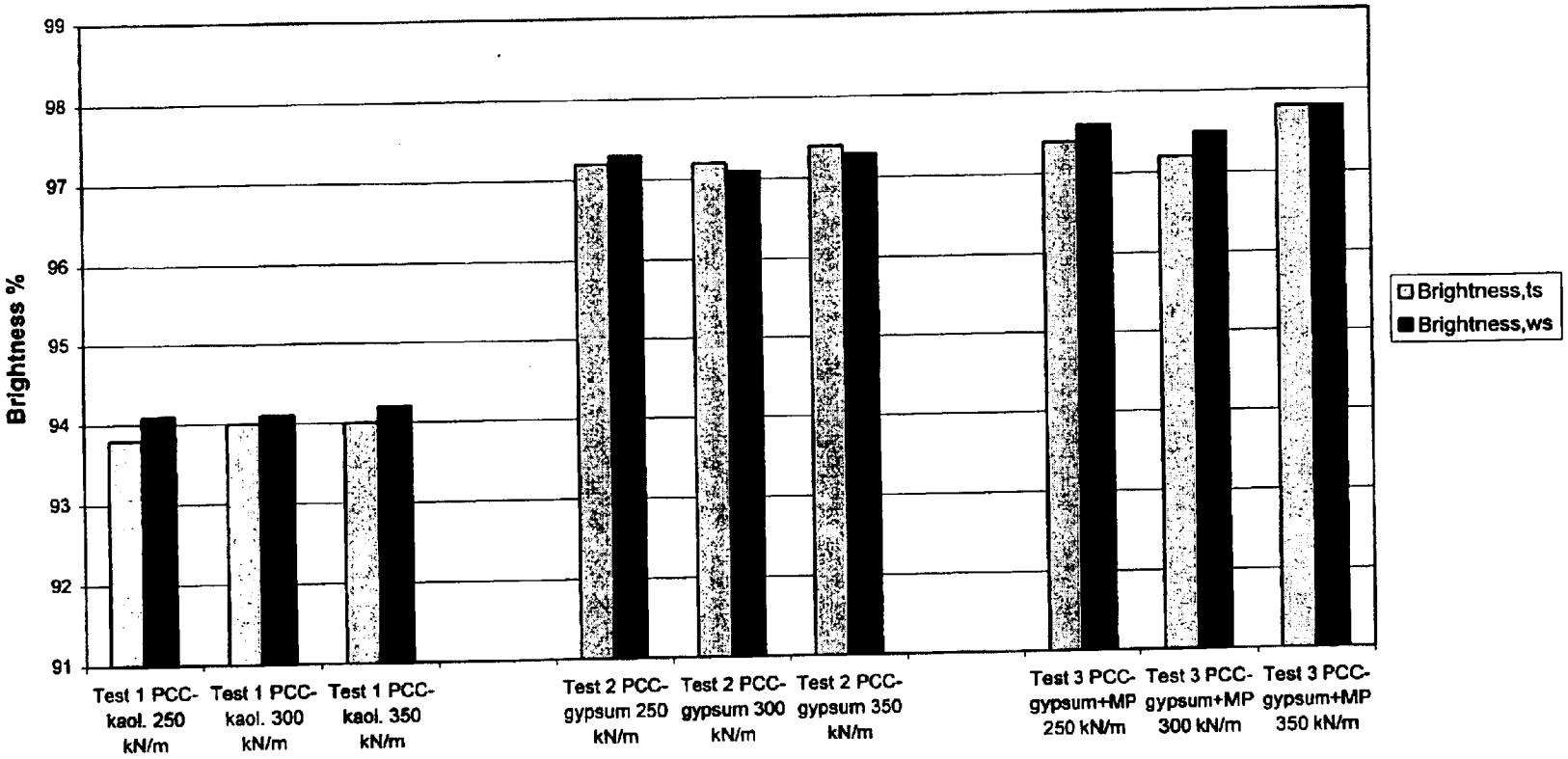
Figure 2:
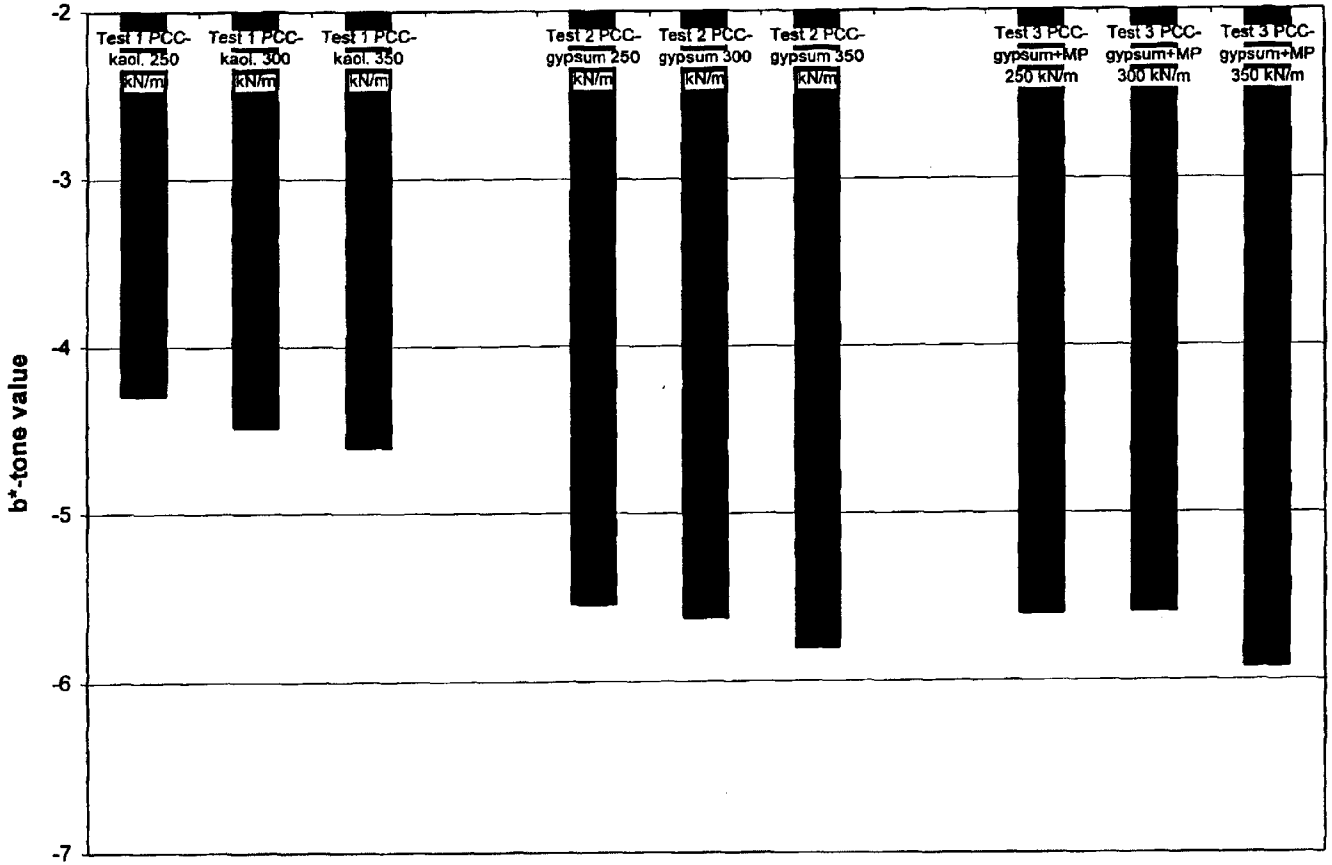
FIG. 2 depicts the b*-tone of glossy papers in different tests.
Figure 3:
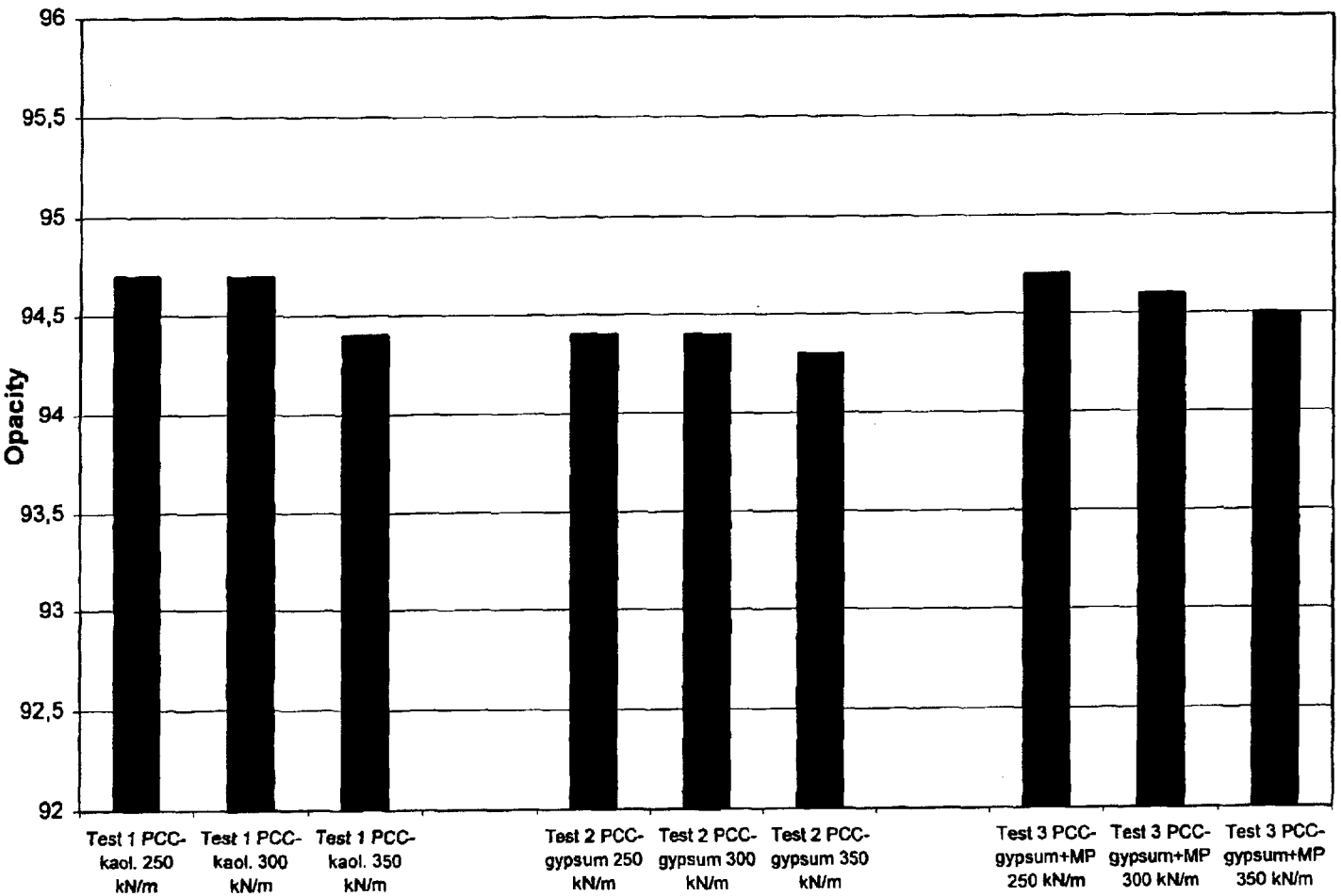
FIG. 3 depicts the opacity of glossy papers in different tests.
Figure 4:
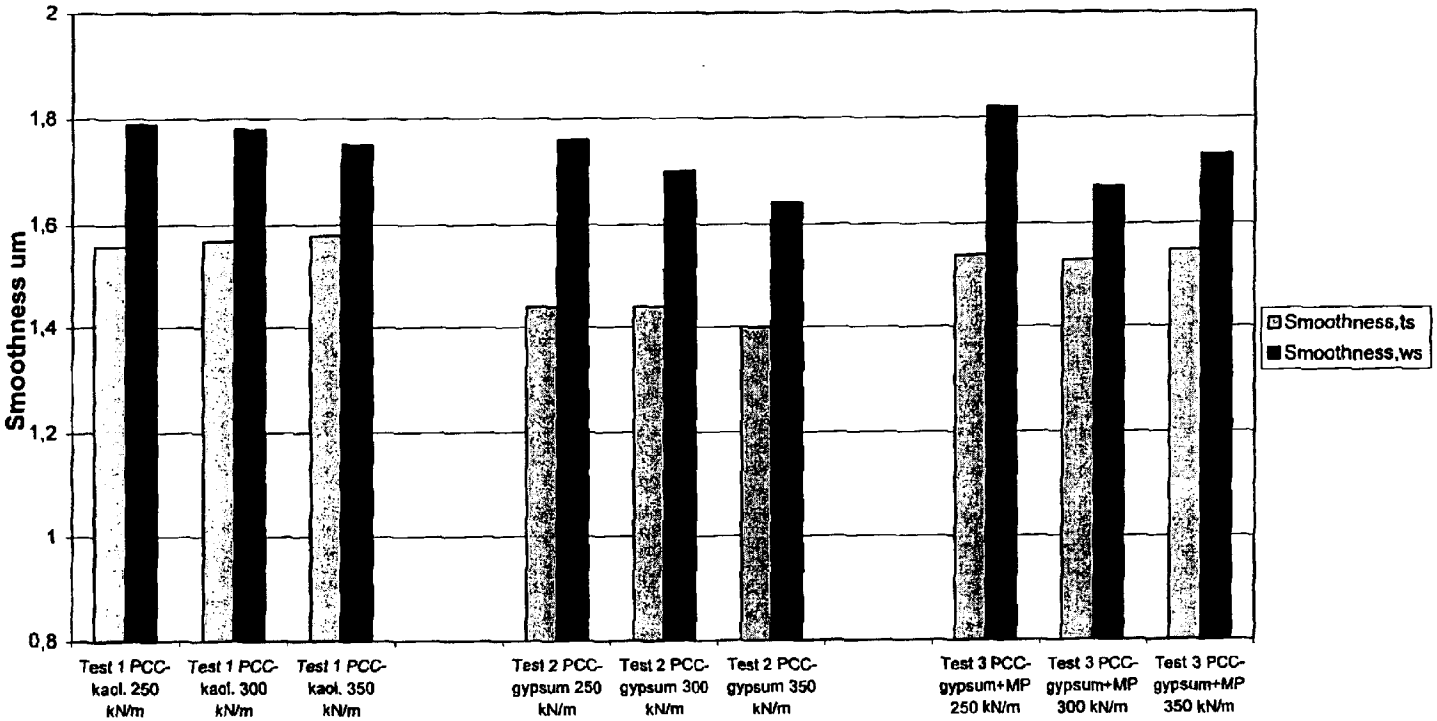
FIG. 4 depicts the smoothness of glossy papers in different tests.
Figure 5:
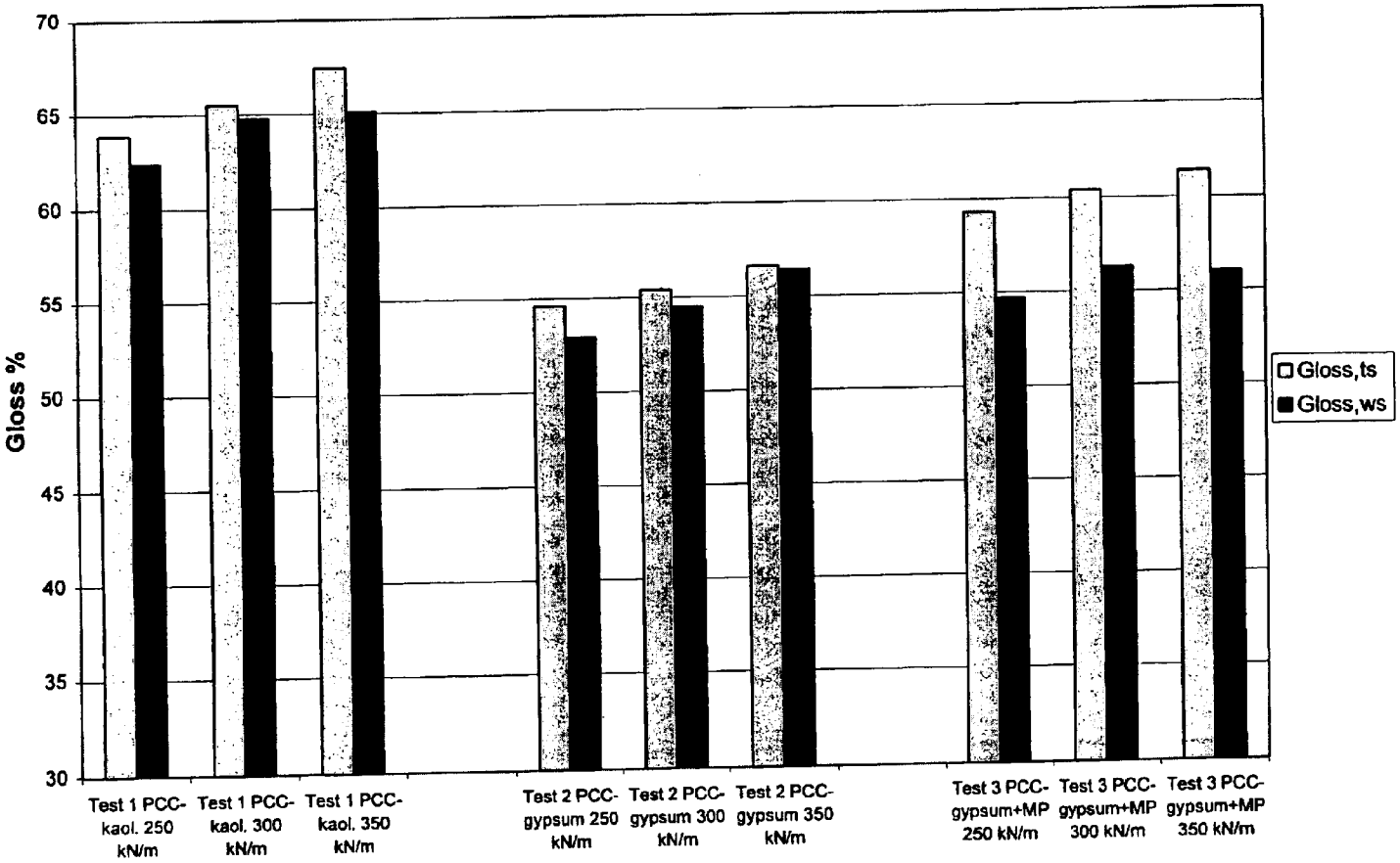
FIG. 5 depicts the gloss of glossy papers in different tests.

In the figures, ts indicates the top side of the paper and ws the wire side of the paper.

In the present invention, the term 'paper' denotes both paper and board. The invention is indeed generally suitable for coating fibrous webs having a grammage of approx. 50–450 g/m$^2$. The base paper may be wood-containing paper or woodfree paper. Wood-containing base papers may contain mechanical or chemimechanical pulp, such as groundwood (GW), pressure groundwood (PGW), thermomechanical pulp (TMP) or chemimechanical pulp (CMP; CTMP). In mechanical pulp production, the wood raw material is defibrated by grinding blocks mechanically under normal pressure (GW) or under elevated pressure (PGW) or by refining chips in the presence of steam (TMP). Chemimechanical pulp production includes both a chemical and a mechanical defibration step. Chemimechanical processes are the CMP and CTMP processes; in the CMP process, wood raw material is refined under normal pressure, whereas in the CTMP process, pressure refiner pulp is produced. The yield of the CMP process is in general smaller than that of the CTMP process (less than 90%), which is due to the fact that its chemicals dosage is higher. In general, wood-containing base papers contain chemical cellulose pulp, in particular softwood pulp, which serves as a reinforcement pulp and gives the web more strength. The amount of the chemical pulp is approx. 1–60% by weight, preferably approx. 10–40% by weight. The mechanical pulp may be derived from softwood or hardwood. In the examples below, the coating of a paper web containing a chemimechanical pulp prepared from aspen is described. By means of the coating composition according to the invention, a good cover and a high brightness are obtained, which is of special benefit in the coating of wood-containing base papers. These papers are known to have a lower brightness than have woodfree base papers, and as a consequence, a conventionally coated paper tends to look mottled.

Woodfree base papers may contain softwood or hardwood pulp produced by a chemical cooking process known per se, such as a conventional sulfate process, extended sulfate cooking, sulfite process, neutral sulfite process, or organosolv process such as peroxoacid cooking.

Both wood-containing and woodfree base papers are preferably bleached to a brightness of over 80% by a conventional bleaching method, such as ECF or TCF bleaching. It is also possible to use bleaching sequences which include chlorine gas steps.

It should be pointed out that, even though reference is made above to wood as the raw material of the paper, the fibrous raw material used may also be annual or perennial plants, such as bagasse and reed canary grass.

Coating mixes according to the invention may be used as single-coat mixes and as so-called pre- and/or surface-coat mixes. In general, the coating mix according to the invention contains a mixture of gypsum and calcium carbonate pigments 10–100 parts by weight, at least one binder 0.1–30 parts by weight, and other additives known per se 0.1–10 parts by weight.

A typical composition of the pre-coat mix is as follows:

| | |
|---|---|
| coating pigment (gypsum/calcium carbonate) | in total 100 parts by weight |
| binder | 1–20% of the weight of the pigment |
| additives and auxiliary agents | 0.1–10% of the weight of the pigment |
| water | balance |

In the pre-coating mix the ratio of gypsum pigments to calcium carbonate pigments, calculated by weight, is the same as is specified below for single-coat or surface-coat mixes, i.e. approx. 20:80 . . . 95:5.

Water is added to the pre-coat mix so that the dry solids content will in general be 40–70%.

According to the invention, the composition of a single-coat mix (or possibly surface-coat mixture) is, for example, as follows:

| | |
|---|---|
| coating pigment I (gypsum) | 10–95 parts by weight |
| coating pigment II (carbonate) | 5–90 parts by weight |
| coating pigment III (e.g. kaolin) | 0–85 parts by weight |
| pigment in total | 100 parts by weight |
| binder | 1–20% of the weight of the pigment |
| additives and auxiliary agents | 0.1–10% of the weight of the pigment |
| water | balance |

Water is added so that the dry solids content in a coating mix such as this is typically 50–75%.

The structure given by a mixture of needle-like gypsum pigments and spherical calcium carbonate particles (in particular PCC particles), the structure evidently being house-of-cards-like, in itself provides a good cover. In order to improve this further, in the coating compositions according to the invention, presented above, there are preferably used pigments having an abrupt particle size distribution, in which case at maximum 35% of the pigment particles are smaller than 0.5 $\mu$m, preferably at maximum 15% are smaller than 0.2 $\mu$m. The abrupt distribution is advantageous in both gypsum and calcium carbonate.

Gypsum constitutes at least 10%, most suitably 30%, preferably 50%, especially preferably at least 60%, of the weight of the coating pigment. The upper limit for gypsum is in general approx. 80%, and thus an especially preferred range is 60–80% of the weight of the pigment. Typically the amount of carbonate is at least 10%, preferably at least 20%.

Mineral pigments usable in addition to calcium carbonate and gypsum (calcium sulfate) include any conventional pigments, some examples of which are aluminum silicate, kaolin (hydrous aluminum silicate), aluminum hydroxide, magnesium silicate, talc (hydrous magnesium silicate), titanium dioxide and barium sulfate, as well as mixtures thereof. Synthetic pigments are also usable. Preferably the coating composition contains at maximum 10% mineral pigment other than gypsum and carbonate.

Of the pigments mentioned above, the main pigments are precipitated or ground calcium carbonate and gypsum, which in general constitute over 50% of the dry solids of the coating mix. Calcined kaolin, titanium dioxide, satin white, aluminum hydroxide, sodium silico-aluminate and plastics pigments are additional pigments, and their amounts are in general less than 25% of the dry solids in the mix. Special pigments that can be cited include special-quality kaolins and calcium carbonates, as well as barium sulfate and zinc oxide.

It should be pointed out further that the surface coat in a double coat may contain any of the pigments mentioned above, but it may equally comprise a coat according to the invention.

The following is an example of an especially suitable coating composition according to the invention:

| | |
|---|---|
| gypsum | 10–90 parts and |
| precipitated calcium carbonate | 10–90 parts or |
| ground calcium carbonate | 10–90 parts |
| pigment in total | 100 parts |
| and | |
| binder | 1–20% of the pigment |
| thickener | 0.1–10% of the pigment |

To produce a glossy surface, most suitably a plastics pigment in an amount of 1–20% of the weight of the mineral pigment is incorporated into the coating composition.

According to a preferred embodiment of the invention, the pre-coat in double coats is a gypsum/carbonate mix according to the invention, whereas on the surface there is a conventional coating, in particular one by means of which the surface gloss can be improved. Such a coating mix therefore preferably contains plastics pigments, such as polystyrene pigment. The surface-coat mix may contain as the mineral pigments, in a manner known per se, calcium carbonate, calcium sulfate, aluminum silicate and aluminum hydroxide, magnesium silicate, titanium dioxide and/or barium sulfate, or a mixture thereof.

When gypsum and another pigment are mixed together, there may appear a strong increase in the viscosity of the slurry. This is due to the effect, on the dispersion system of the other pigments, of the calcium ion dissolving from the gypsum. This so-called gypsum shock can be avoided, for example, by mixing the gypsum first in water and by adding the calcium carbonate and any other pigments afterwards under vigorous agitation. A gypsum shock is also not a problem at high gypsum concentrations (>3% of the amount of mineral pigment). It can be stated that, as a rule, whenever a sufficient amount of gypsum is present in the mix (e.g. at least 10% by weight of the amount of pigment) and there is sufficiently strong agitation at the time of mixing, the gypsum shock is avoided. It is also possible to prevent the gypsum shock by treating the gypsum and the other pigment with a dispersant, as described in FI patent publication 84380, the content of which is incorporated into the present application by way of reference.

The binding agents used in the coating composition may be any known binders commonly used in papermaking. Besides individual binders it is also possible to use mixtures of binders. Examples that can be cited of typical binders are synthetic latexes, which are made up of polymers or copolymers of ethylenically unsaturated compounds, e.g. copolymers of the butadiene-styrene type, which possibly also contain a comonomer containing a carboxyl group, such as acrylic acid, itaconic acid or maleic acid, and polyvinyl acetate having comonomers that contain carboxyl groups. Together with the substances cited above, it is possible further to use as binders, for example, water-soluble polymers, starch, CMC, hydroxyethyl cellulose, and polyvinyl alcohol.

Furthermore, it is possible to use in the coating composition conventional additives and auxiliary agents, such as dispersants (e.g. sodium salt of polyacrylic acid), agents affecting the viscosity and water retention of the mixture (e.g. CMC, hydroxyethyl cellulose, polyacrylates, alginates, benzoate), so-called lubricants, hardeners used for improving water-resistance, optical auxiliary agents, anti-foaming agents, pH control agents, and preservatives. Examples of lubricants include sulfonated oils, esters, amines, calcium or ammonium stearates; of agents improving water resistance, glyoxal; of optical auxiliary agents, diaminostilbene disulfonic acid derivatives; of anti-foamers, phosphate esters, silicones, alcohols, ethers, vegetable oils; of pH control agents, sodium hydroxide, ammonia; and finally of preservatives, formaldehyde, phenol, quaternary ammonium salts.

The coating mix can be applied to the material web in a manner known per se. The method according to the invention for coating paper and/or board can be carried out with a conventional coating apparatus i.e. blade coating, or by means of film coating or by JET application.

During the coating, at least on one surface, preferably on both surfaces, a coating layer having a grammage of 5–30 g/m$^2$ is formed.

As stated above, the fiber product is calendered. The calendering may be carried out in a manner known per se, for example, with a supercalender in connection with the after-treatment of the web.

According to a preferred embodiment of the invention, the uncoated web or a web coated in the manner described above is directed to online soft-calendering. The linear pressure in the calendering is generally at least 200 kN/m and the speed of the calendering is at least 800 m/min. The gloss of a paper or board product can be affected significantly by the linear pressure and temperature of calendering. In general, glossy paper products are obtained when calendering is carried out at a high linear pressure and a high temperature (e.g. approx. 120–170° C.). The gloss of these products is over 50%. The paper web is calendered in this case in an online calender having at least two nips formed between a hard roll and a soft roll. The linear pressure in the calendering of paper is, for example, approx. 250–450 kN/m.

According to another embodiment, the calender rolls are not substantially heated. This alternative is suitable for the production of matt papers, in which case a calendered paper web having a gloss below 50% is produced. The paper web is in this case calendered at a linear pressure of, for example, 200–350 kN/m.

By means of the invention it is possible to produce coated and calendered webs of material having excellent printability properties, good smoothness, and high opacity and brightness.

An especially preferable product is coated offset paper in which high gloss is combined with high opacity and bulk. Thus, by coating with gypsum pigment a base paper made from an aspen CTMP possibly containing at maximum 20% softwood fibers and having a brightness of at minimum 70%, the brightness of the web can easily be raised at least to a value of 85% and opacity at least to a value of 90% at a grammage of 90 g/m$^2$. The paper brightness looks visually quite even.

In general the grammage of paper may be 50–450 g/m$^2$. In general the base paper grammage for papers is 30–250 g/m$^2$, preferably 30–80 g/m$^2$, for boards the grammage is 90–400 g/m$^2$.

By coating a base paper of this type, having a grammage of approx. 50–70 g/m$^2$, with a coat of 10–20 g/m$^2$/side and by calendering the paper, a product is obtained having a grammage of 70–110 g/m$^2$, a brightness of at least 90%, an opacity of at least 90%, and a surface roughness of at maximum 1.3 $\mu$m for glossy paper and of at maximum 2.8 $\mu$m for matt paper. The gloss obtained for glossy paper is up to above 65% (Hunter 75).

The following non-restrictive examples illustrate the invention. The measurement results indicated for the paper properties in the examples have been determined by the following standard methods:

Brightness: SCAN-P66-93 (D65/10°)

Freeness, CSF: SCAN M 4:65

Opacity: SCAN-P8:93 (C/2)

Surface roughness: SCAN-P76:95

Bendtsen roughness: SCAN-P21:67

Gloss: Tappi T480 (75/) and T653 (20/)

EXAMPLE 1

Production of Aspen CTMP

Aspen CTMP was prepared by impregnating the chips with chemicals, by refining the impregnated chips in two steps, and by bleaching the pulp with peroxide.

The following conditions were complied with in the process:

Impregnation of Pulp:

In 2 steps, with peroxide and lye and DTPA (chelating of metals), in addition to recycling of the filtrates, both chemicals are added in dosages of approx. 10–15 kg/tonne.

Refining:

1$^{st}$ step pressurized 4–5 bar, pulp drainability (CSF) approx. 300–400 ml 2$^{nd}$ step open/1–2 bar, pulp drainability (CSF) approx. 150–180 ml, after screening the drainability value drops to the desired level, i.e. approx. 90–100 ml.

Bleaching:

In 2 steps (medium consistency and high consistency) with a small amount of water, peroxide and lye each approx. 30 kg/tonne of pulp, target brightness approx. 80.

Thus a pulp can be produced which has the following properties; in this example, 85% of the fibers were aspen and 15% were spruce.

| | |
|---|---|
| Freeness, CSF 90 | |
| PFI shives, | 0.05% |
| Result of BauerMcNett fiber screening: | 3.3% |
| retained on 28 mesh | |
| 28/48 | 31.9% |
| 48/100 | 19.0% |
| 100/200 | 13.5% |
| passed 200 mesh | 32.3% |
| grammage g/m$^2$ | 64.2 |
| density, kg/m$^3$ | 549 |
| air resistance, Gurley, s | 106 |
| brightness % | 77.5 |
| light scattering coefficient m$^2$/kg | 58.0 |
| tensile index, Nm/g | 35.0 |
| tear index, mN m$^2$/g | 3.3 |
| internal bond strength, J/m$^2$ | 135 |

EXAMPLE 2

Production of Base Paper

Base paper was produced in a production-scale test from the CTMP according to Example 1, as follows:

The base paper was produced from a mixture into which there were dosed:

25% reject pulp derived from the normal production of the mill and consisting of birch sulfate pulp, softwood sulfate pulp and PCC filler 75% fresh pulp containing 50% softwood sulfate pulp refined to the level of SR 25 and 50% aspen CTMP according to Example 1. The aspen CTMP was not postrefined separately at all at the paper mill; the pulp underwent a very light refining treatment in so-called machine pulp refining. The machine pulp is made up of softwood sulfate and aspen CTMP together.

In addition, PCC was added to the paper as a filler so that the total filler content (including the filler from the reject) in the machine reels ranged from 11.8 to 13.2%.

The paper machine wire speed was 895 m/min; the possible speed range for this grammage and this paper formula in this machine could be 1100–1200 m/min. The paper was calendered lightly with a machine calender.

Several machine reels of paper were produced for both tests; the grammage in one was approx. 65 g/m$^2$ and the grammage in the other 55 g/m$^2$. The most important quality values of the paper were:

grammage 65.6 g/m$^2$ filler content 12.0% bulk 1.65 kg/dm$^3$ brightness (D65/10° light), top side of paper 95.2 brightness (D65/10° light), wire side of paper 94.8 opacity 89.6%

Bendtsen porosity 420 ml/min

Bendtsen roughness, top side of paper 306 ml/min

Bendtsen roughness, top side of paper 355 ml/min internal bond strength 300 J/m$^2$ tensile strength, machine direction of paper 4.1 kN/m tensile strength, cross direction of paper 1.3 kN/m tear strength, machine direction of paper 439 mN tear strength, cross direction of paper 545 mN

EXAMPLE 3

Coating and Calendering of Glossy Paper

Next, a base paper according to Example 2 was coated and calendered with a pilot apparatus. The coating formulae are given in Table 1.

TABLE 1

| | Test 1. | Test 2. | Test 3. |
|---|---|---|---|
| Opacarb A 40 | 60 | 70 | 66 |
| CoCoat (gypsum) | | 30 | 30 |
| Ropague HP-1055 | | | 4 |
| Hydragloss 90 (kaolin) | 40 | | |
| Styronal FX 8740 | 10 | 10 | 10 |
| Raisional RN 1116 | 4 | 4 | 4 |
| FF-10 | 0.9 | 1.1 | 1.1 |
| Blancophor PSF | 1 | 1 | 1 |

The targeted solids content for the coating paste was 66% and the pH 8.5.

The coating was carried out by JET application at a speed of 1000 m/min. The targeted amount of coating was 13 g/m$^2$ on each side of the paper.

Because PCC and gypsum pigment are by their particle shape not good pigments in terms of paper gloss, there was added to the mix in test 3 a plastics pigment, Ropaque HP-1055, which softens during calendering, thus strongly increasing the gloss of paper.

After the coating, the paper was calendered as follows:

Speed 1100 m/min

Linear pressures 250, 300 and 350 kN/m

Calendering temperature 150° C.

Nips hard/soft+soft/hard

Thus there was obtained a paper having very good quality properties for heatset-offset printing. The technical properties of the paper are shown in FIGS. 1–5.

It is conspicuous in the results in FIG. 1 that the brightness of paper improves by over 3 units when gypsum pigment is used. The reference is a mixture of PCC and kaolin. While brightness increases, the b-tone value (FIG. 2) decreases, which is in practice a desirable property, and these phenomena are indeed associated with each other. In general, a decrease in opacity is associated with an increase in brightness, but according to the results (FIG. 3), coating mixes containing gypsum do not suffer from this. The opacities (FIG. 3) and smoothness (FIG. 4) in all the tests comparable as regards the linear pressure of calendering are at the same level. The gloss of papers containing gypsum pigment (FIG. 5) has dropped to a level lower than that of the reference papers (PCC-kaolin pastes), but by adding to the mixture a plastics pigment it is possible to rectify the gloss while the other properties remain at an advantageous level.

It is advisable to examine the above results from the viewpoint of the brightness of the pigments.

The brightness values measured from pigment tablets are:

kaolin (Hydragloss 90): 88.5–90.5%

PCC (Opacarb A40): 95% gypsum (CoCoat): 94%

On the basis of these figures it can be expected that the brightness of paper coated with a mixture of PCC and gypsum is better than the brightness of paper coated with a mixture of PCC and kaolin. Usually the brightness values of pigment mixtures can be calculated as mean values weighted with mass proportions, starting from the brightness values of the pigments. Thus there is obtained:

PCC-kaolin mixture at the ratio of 60/40: brightness 92.8%

PCC-gypsum mixture at the ratio of 70/30: brightness 94.7%

Of this brightness improvement of approx. 2 units, in general an improvement of 1–1.5 is seen in the completed paper if the other paper-making parameters are maintained unchanged. The result depends on the brightness of the base paper and on the amount of coating, but at least in the situation of Examples 1–3 it is easy to make the above estimate. When the results in FIG. 1 are examined from this viewpoint, the improvement of approx. 3.5 units in brightness is surprisingly high.

The fact that at the same time opacity remains unchanged is also surprising, because usually opacity decreases when brightness increases.

Figure 6:
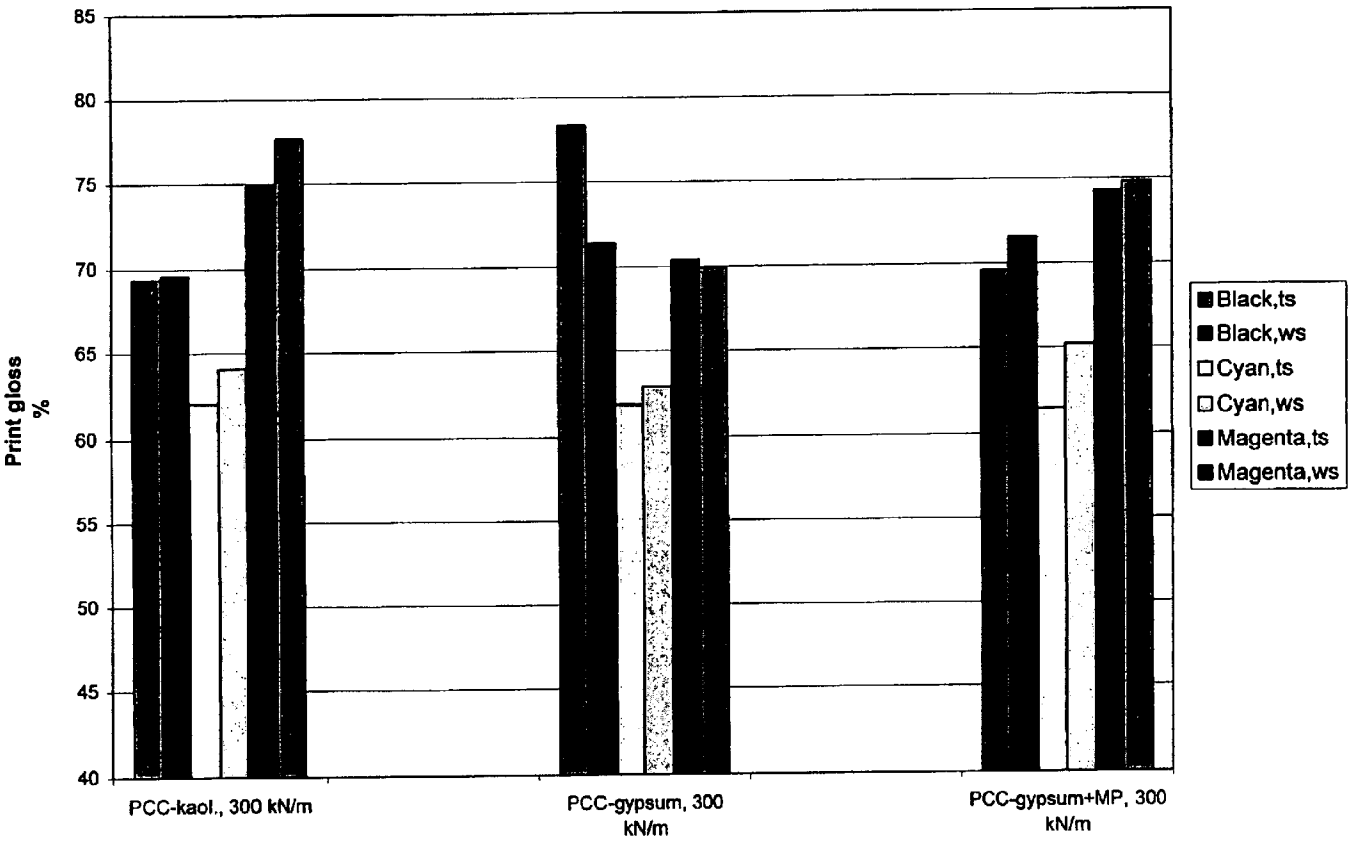
FIG. 6 depicts the printing gloss of glossy papers in different tests.
Figure 7:
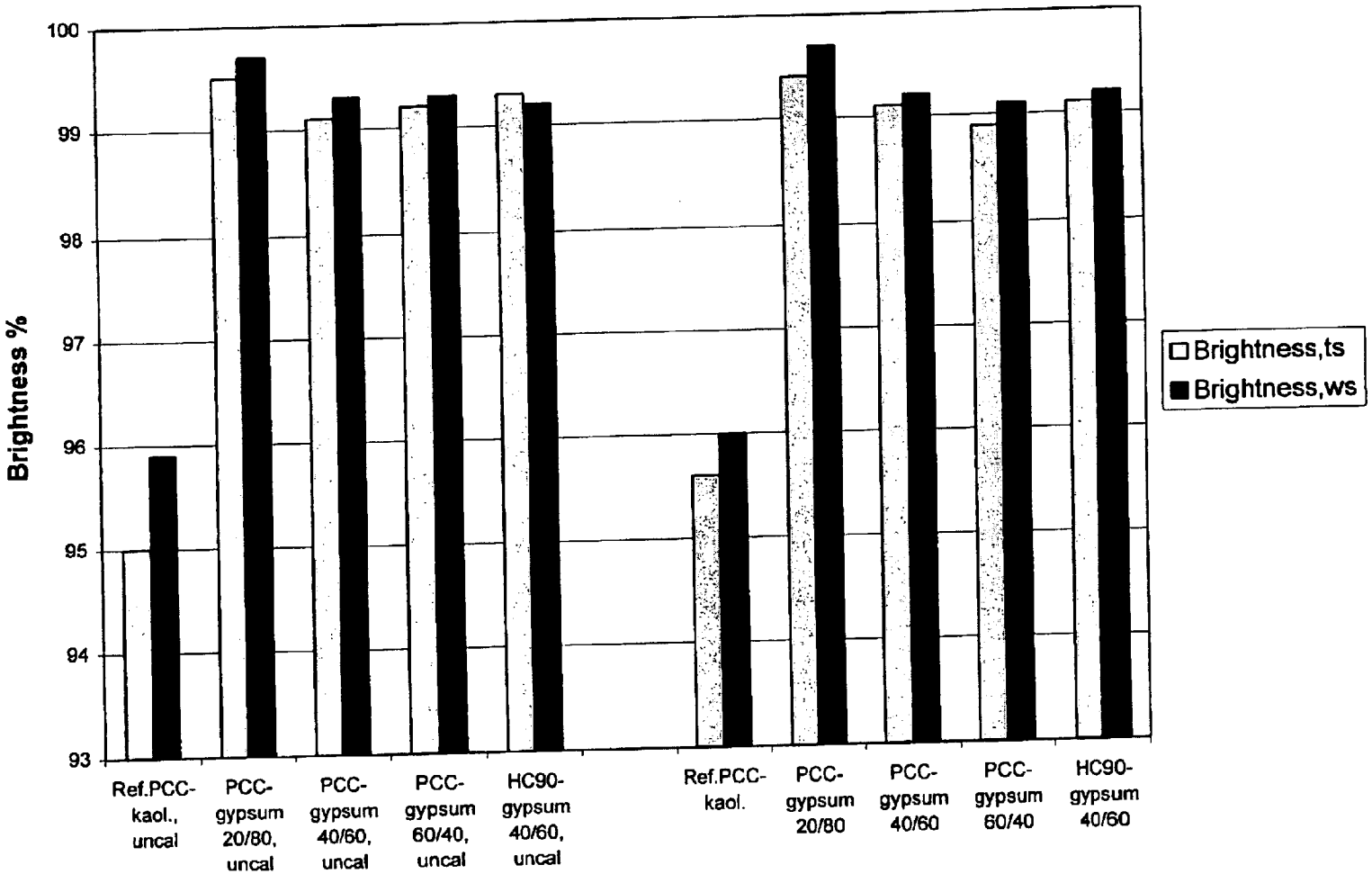
FIG. 7 depicts the brightness of matt papers in different tests.
Figure 8:
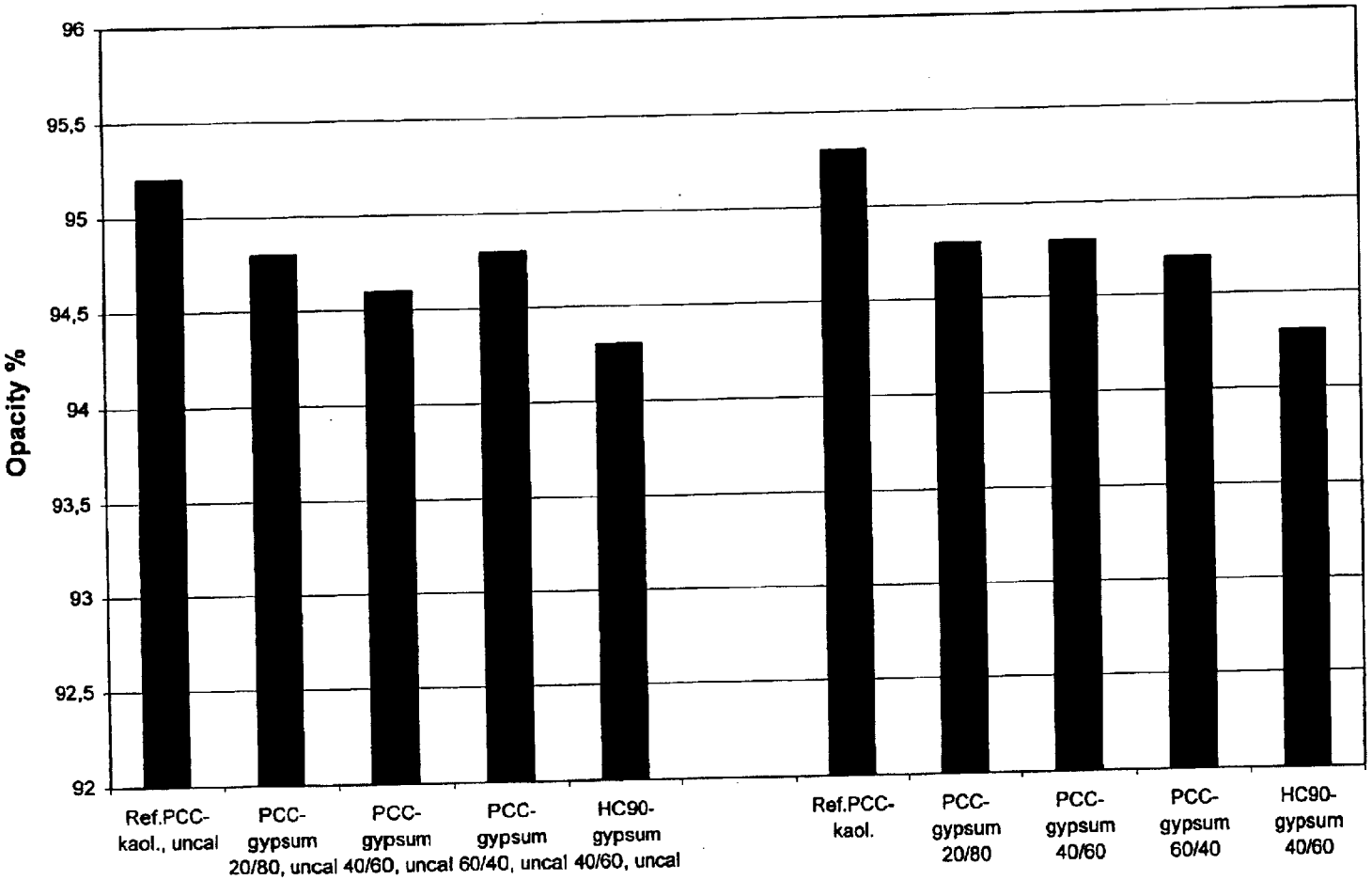
FIG. 8 depicts the opacity of matt papers in different tests.
Figure 9:
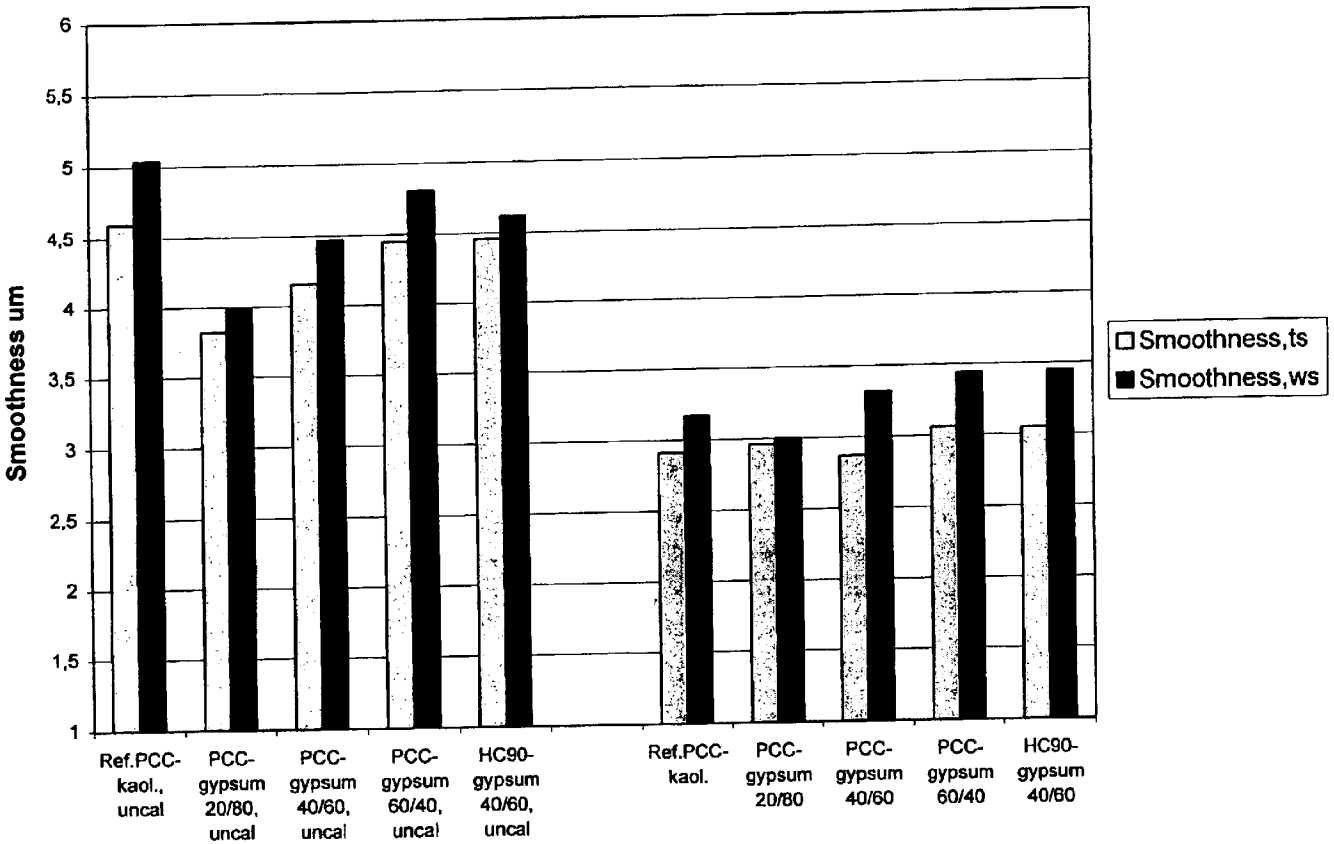
FIG. 9 depicts the smoothness of matt papers in different tests.
Figure 10:
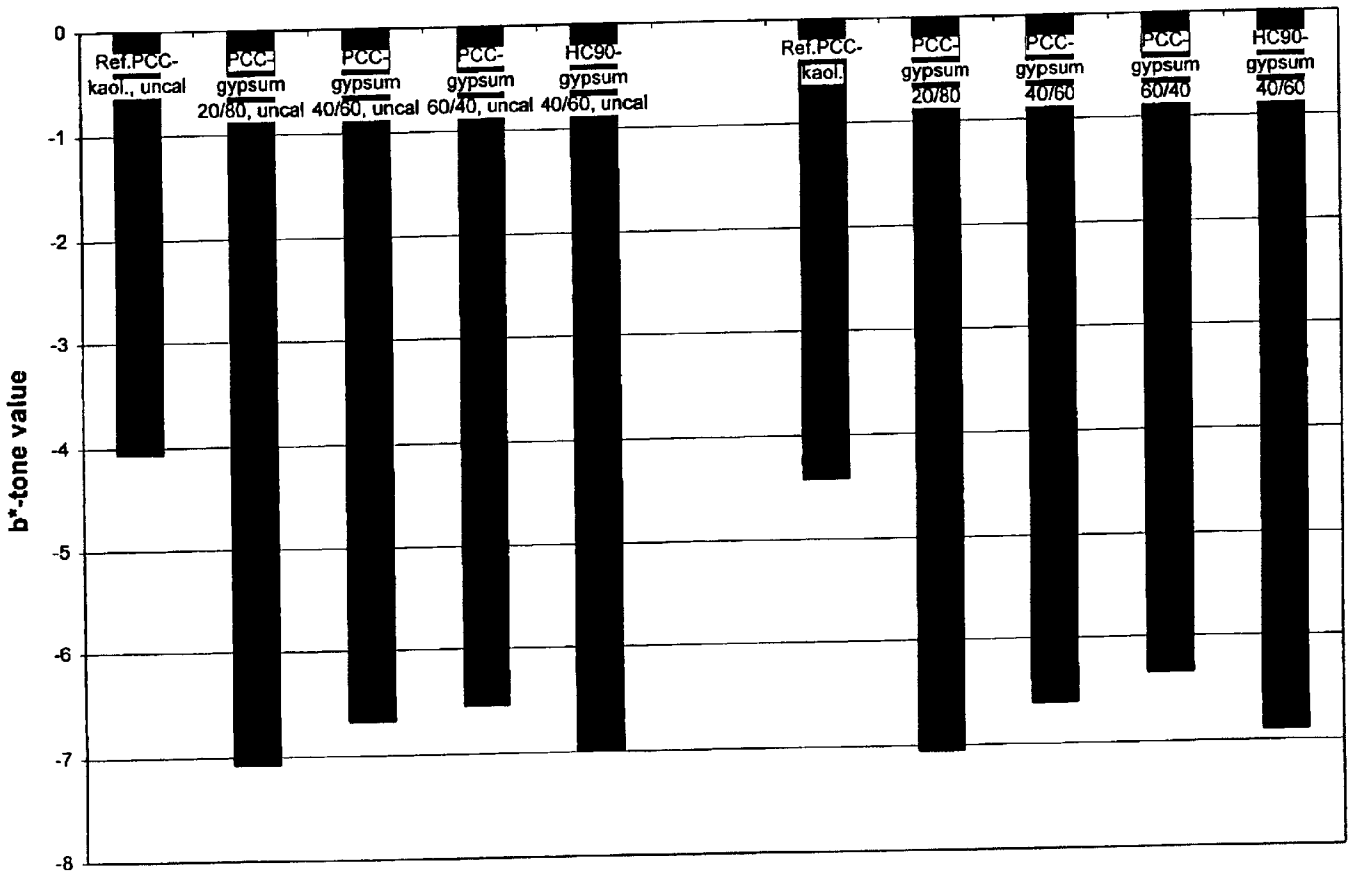
FIG. 10 depicts the b*-tone of matt papers in different tests.
Figure 11:
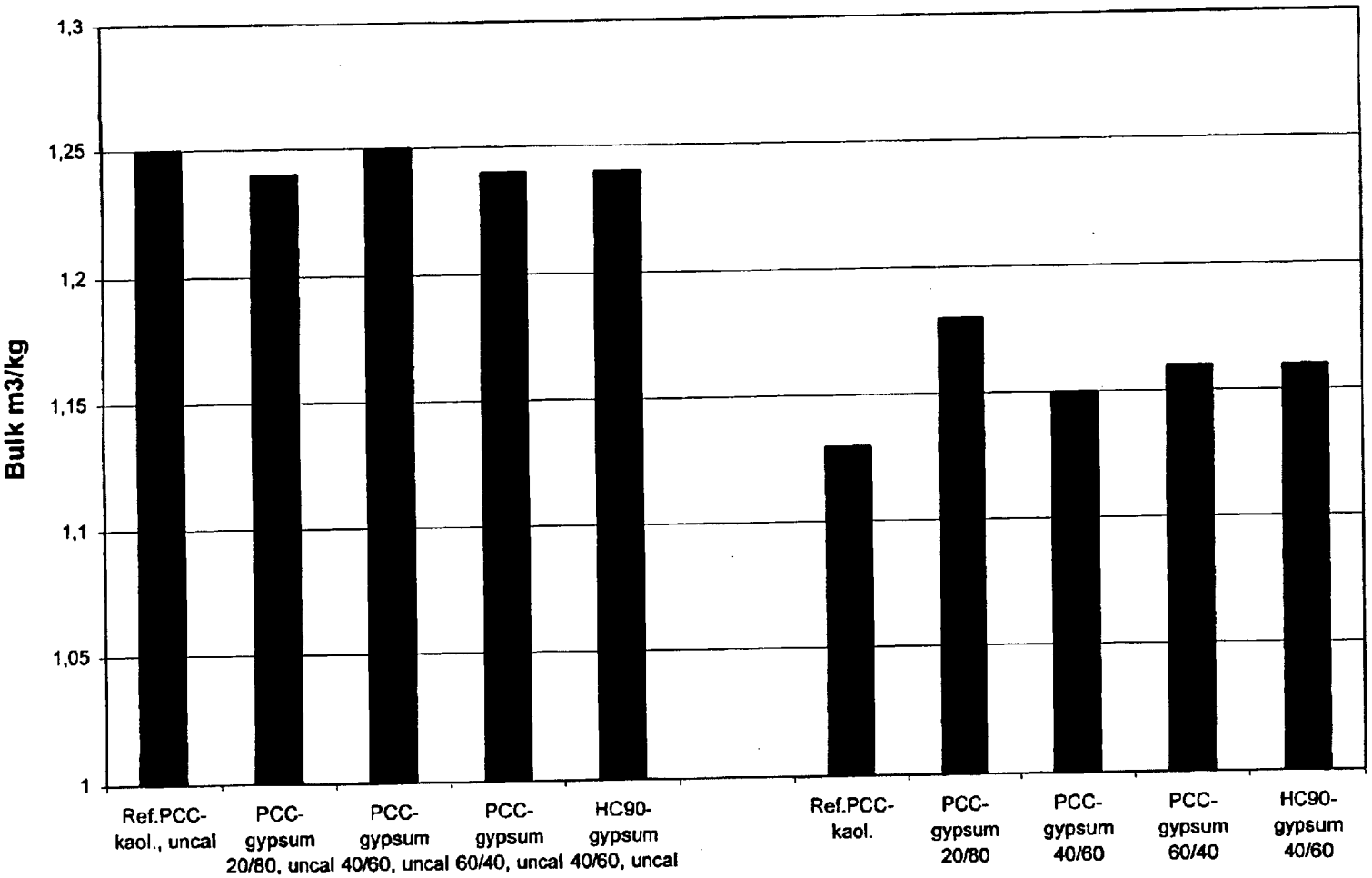
FIG. 11 depicts the bulk of matt papers in different tests.

The print gloss measurement, FIG. 6, also indicates the surprisingly advantageous house-of-cards structure of the PCC-gypsum mixture. In general, specifically kaolin-containing pastes are good with respect to print gloss, since the printing ink settles on the surface of plate-like kaolin particles and in the narrow pores between them without penetrating deep into the coating. For the PCC-gypsum coating we would have expected clearly lower print glosses than for the PCC kaolin mixture, but the print glosses are either at the same level or even better.

EXAMPLE 4

Coating and Calendering of Matt Paper

Base paper according to Example 2 was next coated and calendered with a pilot apparatus. The coating formulae are described in Table 2.

TABLE 2

| | Test 1. | Test 2. | Test 3. | Test 4. | Test 5. |
|---|---|---|---|---|---|
| Opacarb A60 | 80 | 20 | 40 | 60 | |
| HC-90 | | | | | 40 |
| CoCoat (gypsum) | | 80 | 60 | 40 | 60 |
| Suprawhite 80 | 20 | | | | |
| Styronal FX 8740 | 13 | 13 | 13 | 13 | 13 |
| FF-10 | 0.7 | 1.2 | 1.2 | 1.2 | 1.2 |
| Sterocoll FD | 0.3 | | | | |
| Dispersant | | 0.15 | 0.15 | 0.15 | |
| Blancophor PSF | 1 | 1 | 1 | 1 | 1 |

The targeted solids content for the coating paste was 65–66% and the pH 8.5.

The coating was carried out by JET application at a speed of 1000 m/min. The targeted amount of coating was 13 g/m$^2$ on each side of the paper.

After the coating, the paper was calendered as follows:

Speed 1100 m/min

Linear pressure range 300 kN/m

The rolls were not heated

Nips: 1 soft/soft

Thus a paper was obtained which had very good quality properties for heatset-offset printing. The technical properties of the paper are shown in FIGS. 7–11; 'uncal' indicates uncalendered samples.

In a manner corresponding to those given for glossy paper in Example 3, the pigment mixture brightnesses estimated for matt paper, starting from the brightness values of the pigments are:

PCC-kaolin mixture at the ratio of 80/20: brightness 93.9

PCC-gypsum mixture at the ratio of 20/80: brightness 94.2

According to the calculation, an increase of perhaps 0.2 units in brightness would in practice be expectable. According to FIG. 7, however, the increase in brightness was approx. 3.5 units, which is a highly surprising result.

Also for matt papers, the print gloss measurements are surprising. Here also it was expected that, under the effect of gypsum, print gloss would drop as compared with the PCC-kaolin mixture. However, the print gloss values of the PCC-gypsum coating are only slightly lower than those for the PCC-kaolin mix.

Furthermore, it is seen that instead of PCC it is also possible to use ground carbonate (HC-90). The result in FIG. 8, however, shows that PCC is more advantageous than ground carbonate in terms of opacity. As regards smoothness (FIG. 9) it can be noted that the PCC-gypsum mixtures correspond to the other pastes. Furthermore, an advantage provided by the increasing brightness is seen in the b-tone (FIG. 10), i.e. the b-tone decreases. With respect to bulk (FIG. 11), the replacing of plate-like kaolin with needle-like gypsum is advantageous and the bulk improves by up to approx. 5%.

What is claimed is:

1. A process for producing a coated paper web, according to which process a paper web having a grammage of 30 to 250 g/m$^2$ is formed from a fibrous raw material in a paper machine, the paper web is coated with a pigment-containing coating composition, and the coated paper web is calendered at a linear pressure of at least 200 kN/m, characterized in that the coating composition contains as a mineral pigment mainly a mixture of gypsum and calcium carbonate, the amount of gypsum being at minimum 10% by weight of the total amount of gypsum and calcium carbonate to form a coating layer having a grammage of 5 –30 g/m$^2$ on at least one of the surfaces of the paper web.

2. The process according to claim 1, characterized in that the coating composition contains

| | |
|---|---|
| ground or precipitated calcium carbonate | 10–90 parts by weight and |
| gypsum | 90–10 parts by weight |
| pigment in total | 100 parts by weight |
| and | |
| binder | 1–20% by weight of the pigment |
| thickener | 0.1–10% by weight of the pigment. |

3. The process according to claim 1, characterized in that the coating composition contains a plastics pigment in an amount of 1–20% by weight of the mineral pigment.

4. The process according to claim 1, characterized in that the coating composition contains another mineral pigment at maximum 10%.

5. The process according to claim 1, characterized in that gypsum constitutes at minimum 10% of the weight of the coating pigment.

6. The process according to claim 1, characterized in that the coating is carried out by jet application.

7. The process according to claim 1, characterized in that a coating layer having a grammage of 5–30 g/m$^2$ is formed on both of the surfaces of the paper web.

8. The method according to claim 1, characterized in that the coated paper is calendered in an online soft-calender.

9. The process according to claim 8, characterized in that the calender rolls are not substantially heated.

10. The process according to claim 9, characterized in that a calendered paper web having a gloss below 50% is produced.

11. The process according to claim 9, characterized in that the paper web is calendered at a linear pressure of 200–350 kN/m.

12. The process according to claim 1, characterized in that the calendering temperature is 120–170° C.

13. The process according to claim 12, characterized in that a calendered paper web having a gloss above 50% is produced.

14. The process according to claim 13, characterized in that the paper web is calendered in an online calender having at least two nips formed between a soft roll and a hard roll.

15. The process according to claim 13, characterized in that the paper web is calendered at a linear pressure of 250–450 kN/m.

16. The process according to claim 1, characterized in that said paper web comprises a fibrous material, at least a part of which is made up of a chemimechanical pulp of a species of the Populus family.

17. The process according to claim 1, characterized in that the coating composition is used as a single-coat mixture or a pre-coat mixture.

18. Electrophotography paper, characterized in that it has been produced by the process according to claim 1.

19. The paper according to claim 18, characterized in that it comprises a coated offset paper.

20. The process according to claim 1, characterized in that gypsum constitutes at minimum 30% of the weight of the coating pigment.

21. The process according to claim 1, characterized in that gypsum constitutes at minimum 50% of the weight of the coating pigment.

22. The process according to claim 1, characterized in that gypsum constitutes at minimum 60% of the weight of the coating pigment.

* * * * *

UNITED STATES PATENT AND TRADEMARK OFFICE

CERTIFICATE OF CORRECTION

PATENT NO. : 6,893,536 B2 
DATED : May 17, 2005
INVENTOR(S) : Teuvo Ilmonen, Soili Hietanen and Markku Leskelä

It is certified that error appears in the above-identified patent and that said Letters Patent is hereby corrected as shown below:

Title page,
Item [73], Assignee, "M-Real Oyj" should be -- M-REAL OYJ --.

Signed and Sealed this

First Day of November, 2005

JON W. DUDAS
*Director of the United States Patent and Trademark Office*